US011827859B1

(12) United States Patent
Culley et al.

(10) Patent No.: US 11,827,859 B1
(45) Date of Patent: Nov. 28, 2023

(54) BIOMASS GASIFIER SYSTEM WITH ROTATING DISTRIBUTION MANIFOLD

(71) Applicant: NuPhY, Inc., Pullman, WA (US)

(72) Inventors: Jacob M. Culley, Spokane, WA (US); Daniel A. Howard, Cheney, WA (US); Tim E. Farley, Spokane, WA (US)

(73) Assignee: NuPhY, Inc., Pullman, WA (US)

( * ) Notice: Subject to any disclaimer, the term of this patent is extended or adjusted under 35 U.S.C. 154(b) by 35 days.

(21) Appl. No.: 17/735,496

(22) Filed: May 3, 2022

(51) Int. Cl.
*C10J 3/00* (2006.01)
*C10J 3/72* (2006.01)

(52) U.S. Cl.
CPC ..... *C10J 3/005* (2013.01); *C10J 3/721* (2013.01); *C10J 3/723* (2013.01); *C10J 2200/09* (2013.01); *C10J 2300/0916* (2013.01); *C10J 2300/0959* (2013.01)

(58) Field of Classification Search
CPC ..... C10J 2300/0916; C10J 2300/0959; C10J 3/723; C10J 2200/09
See application file for complete search history.

(56) References Cited

U.S. PATENT DOCUMENTS 4,040,800 A * 8/1977 Rudolph ..... C10J 3/32 241/245
4,075,953 A * 2/1978 Sowards ..... F23G 5/30 34/585
4,278,064 A 7/1981 Regueiro
4,428,308 A 1/1984 Birchfield
4,452,611 A 6/1984 Richey
4,502,633 A 3/1985 Saxon
4,599,092 A 7/1986 Eichelsbacher
4,764,185 A 8/1988 Mayer
(Continued)

FOREIGN PATENT DOCUMENTS

CN 101693842 A 4/2010
CN 102492443 A 6/2012
(Continued)

OTHER PUBLICATIONS https://www.build-a-gasifier.com/PDF/Handbook_of_Biomass_Downdraft_Gasifier_Engine_Systems.pdf; "Handbook of Biomass Downdraft Gasifier Engine Systems"; Solar Energy Research Institute under U.S. Department of Energy; Mar. 1988.
(Continued)

*Primary Examiner* — Imran Akram
(74) *Attorney, Agent, or Firm* — Neustel Law Offices

(57) ABSTRACT

A biomass gasifier for producing syngas. The biomass gasifier includes a first tube having an air distribution manifold that extend within the gasification chamber. The first tube is rotatably positioned within a second tube, where the second tube is connected to a mixer below the air distribution manifold. The first tube has an air passage that is fluidly connected to an air source to deliver air to the combustion chamber through a plurality of air outlets within the air distribution manifold for distribution. The first tube is independently rotated from the second tube to evenly distribute air within the combustion chamber and the second tube with the mixer are rotated to agitate the biomass within the combustion chamber once a desired operating temperature range within the combustion chamber has been achieved.

19 Claims, 14 Drawing Sheets

(56) References Cited

U.S. PATENT DOCUMENTS

| | | | | |
|---|---|---|---|---|
| 4,872,954 | A | 10/1989 | Hogan | |
| 5,026,403 | A | 6/1991 | Michel-Kim | |
| 5,138,957 | A | 8/1992 | Morey | |
| 5,390,630 | A * | 2/1995 | Virr | C10J 3/005 122/4 D |
| 7,763,088 | B2 | 7/2010 | Feldmann | |
| 7,856,829 | B2 | 12/2010 | Shah | |
| 7,909,899 | B2 | 3/2011 | Diebold | |
| 7,947,155 | B1 | 5/2011 | Green | |
| 8,003,833 | B2 | 8/2011 | Appel | |
| 8,317,886 | B2 | 11/2012 | Graham | |
| 8,423,899 | B1 | 4/2013 | Crane | |
| 8,528,490 | B1 | 9/2013 | Dueck | |
| 9,567,539 | B2 | 2/2017 | Appel | |
| 9,631,151 | B2 | 4/2017 | Appel | |
| 10,047,308 | B2 | 8/2018 | Appel | |
| 2003/0005634 | A1 | 1/2003 | Calderon | |
| 2003/0110994 | A1 | 6/2003 | Lissianski | |
| 2004/0134397 | A1 * | 7/2004 | Ingvarsson | F23L 1/00 110/347 |
| 2004/0182294 | A1 | 9/2004 | Hahn | |
| 2006/0180459 | A1 * | 8/2006 | Bielenberg | C10J 3/66 202/131 |
| 2008/0086945 | A1 | 4/2008 | Wunning | |
| 2008/0244976 | A1 | 10/2008 | Paisley | |
| 2008/0283249 | A1 | 11/2008 | Zubrin | |
| 2009/0061372 | A1 | 3/2009 | Just | |
| 2009/0064578 | A1 | 3/2009 | Theegala | |
| 2010/0096594 | A1 | 4/2010 | Dahlin | |
| 2010/0146858 | A1 | 6/2010 | Zamansky | |
| 2010/0154304 | A1 | 6/2010 | Tsangaris | |
| 2010/0326087 | A1 | 12/2010 | Kawase | |
| 2011/0023363 | A1 | 2/2011 | Mason | |
| 2011/0036014 | A1 | 2/2011 | Tsangaris | |
| 2011/0081290 | A1 | 4/2011 | Carnegie | |
| 2011/0104575 | A1 | 5/2011 | Mui | |
| 2011/0116984 | A1 * | 5/2011 | Rehmat | C10J 3/005 422/184.1 |
| 2011/0248218 | A1 | 10/2011 | Sutradhar | |
| 2012/0145965 | A1 | 6/2012 | Simmons | |
| 2012/0309856 | A1 | 12/2012 | Eilos | |
| 2013/0199920 | A1 | 8/2013 | Demir | |
| 2013/0230433 | A1 | 9/2013 | Watkinson | |
| 2013/0291437 | A1 | 11/2013 | Martella | |
| 2013/0313481 | A1 | 11/2013 | Perez | |
| 2013/0340339 | A1 | 12/2013 | Lee | |
| 2014/0001406 | A1 | 1/2014 | Kar | |
| 2014/0004471 | A1 | 1/2014 | Vandergriendt | |
| 2014/0048744 | A1 | 2/2014 | Avagliano | |
| 2014/0069003 | A1 | 3/2014 | Calderon | |
| 2014/0230327 | A1 | 8/2014 | Edmondson | |
| 2015/0059245 | A1 | 3/2015 | Appel | |
| 2015/0090938 | A1 | 4/2015 | Meyer | |
| 2015/0232771 | A1 | 8/2015 | Bell | |
| 2015/0374935 | A1 | 12/2015 | Bouchard | |
| 2016/0024389 | A1 * | 1/2016 | Endou | F01K 11/02 60/670 |
| 2016/0068770 | A1 | 3/2016 | Appel | |
| 2016/0068771 | A1 | 3/2016 | Appel | |
| 2016/0068772 | A1 | 3/2016 | Appel | |
| 2017/0044450 | A1 * | 2/2017 | Waage | C10J 3/005 |
| 2017/0073593 | A1 | 3/2017 | Appel | |

FOREIGN PATENT DOCUMENTS

| | | | |
|---|---|---|---|
| JP | 2009228958 | A | 10/2009 |
| JP | 2011126997 | A | 6/2011 |
| KR | 1999081315 | A | 11/1999 |
| KR | 20020023280 | A | 3/2002 |
| KR | 100679295 | B1 | 2/2007 |
| KR | 100824599 | B1 | 4/2008 |
| KR | 20080067676 | A | 7/2008 |
| KR | 20110026933 | A | 3/2011 |
| WO | 2013036694 | A1 | 3/2013 |
| WO | 2013149170 | A1 | 10/2013 |

OTHER PUBLICATIONS

PCT International Search Report and Written Opinion for PCT/US2015/048564; dated Oct. 29, 2015.

http://allpowerlabs.com/products/100kw-powertainer; All Power Labs Powertainer Webpage, Jun. 16, 2015.

https://www.youtube.com/watch?v=GrXt7RxWDzw; "100kW Powertainer" YouTube Video by ALL Power Labs You Tube; Sep. 11, 2012.

PCT International Search Report and Written Opinion for PCT/US2014/054143; dated Dec. 23, 2014.

* cited by examiner

BIOMASS GASIFIER SYSTEM WITH ROTATING DISTRIBUTION MANIFOLD

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

The described example embodiments in general relate to biomass gasifiers for producing syngas.

Biomass gasification involves the incomplete combustion of biomass (e.g. wood, wood mill residues, wood wastes, wood chips, bark, sawdust, waste paper, plant fibers, forestry residues, agricultural residues, straw, dedicated biomass crops, yard wastes, animal wastes, manure, etc.) to produce a gaseous compound known as syngas. The biomass may be in various physical forms having various densities such as, but not limited to, fiber, straw, chips, dust, or pellets. During gasification of biomass, the biomass is heated to a high temperature range (e.g., 700 to 800 degrees Celsius) which results in the production of syngas (hydrogen, methane, carbon monoxide and carbon dioxide) and solid residues (char). The syngas may be used in various applications such as, but not limited to, electricity generation or heat generation.

SUMMARY

Some of the various embodiments of the present disclosure relate to a biomass gasifier that can effectively produce syngas. Some of the various embodiments of the present disclosure produce a syngas with a high percentage of H2, CH4 and CO. Some of the various embodiments of the present disclosure include a first tube having an air distribution manifold that extend within the gasification chamber. The first tube has an air passage that is fluidly connected to an air source to deliver air to the combustion chamber through a plurality of air outlets within the air distribution manifold for distribution. In some embodiments, the first tube is rotatably positioned within a second tube, where the second tube is connected to a mixer below the air distribution manifold. In some embodiments, the first tube is independently rotated from the second tube to evenly distribute air within the combustion chamber and the second tube with the mixer are rotated to agitate the biomass within the combustion chamber.

There has thus been outlined, rather broadly, some of the embodiments of the present disclosure in order that the detailed description thereof may be better understood, and in order that the present contribution to the art may be better appreciated. There are additional embodiments that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

Figure 1:
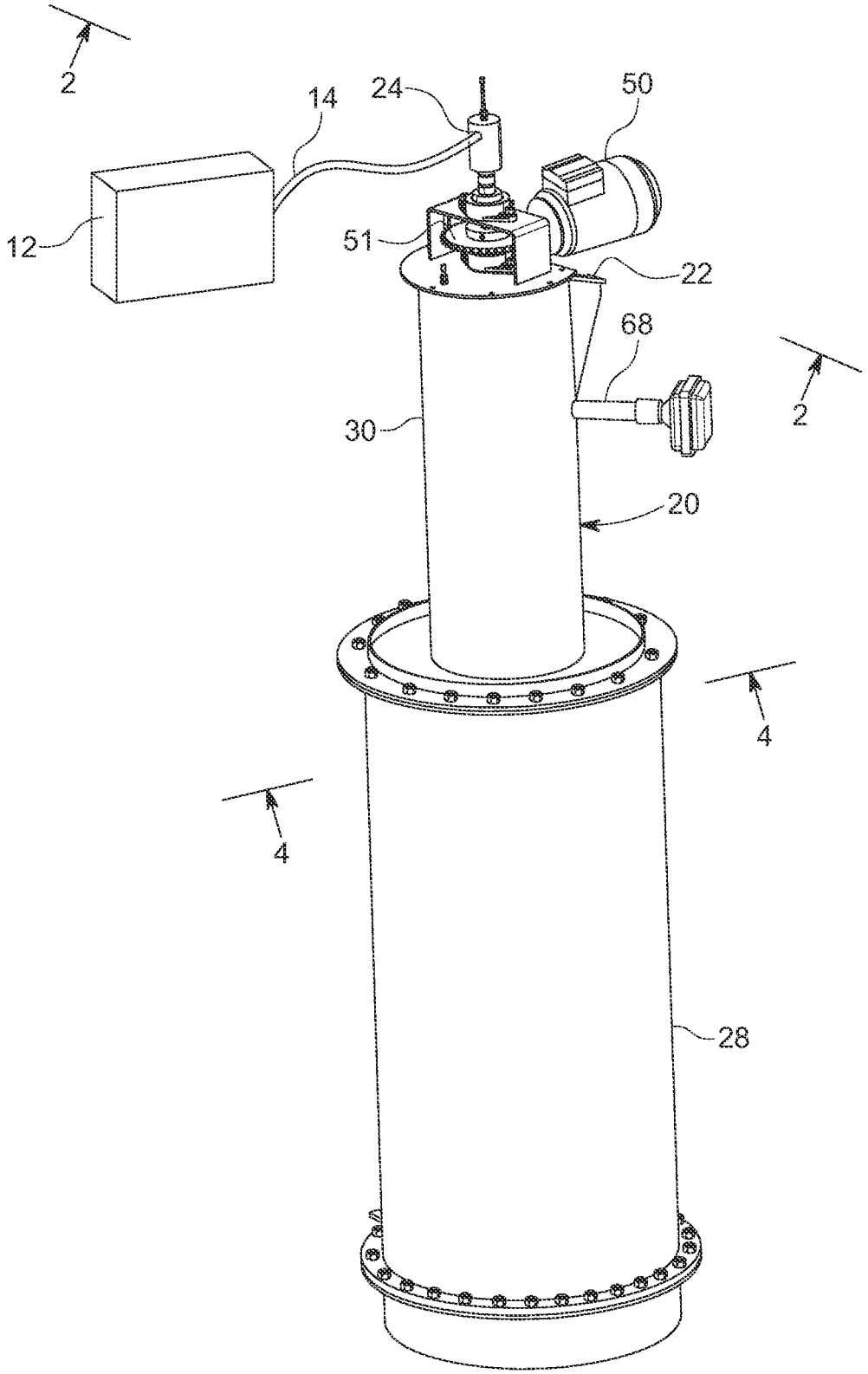
FIG. 1 is an upper perspective view of a biomass gasifier in accordance with an example embodiment.

A. Overview.

Some of the various embodiments of the present disclosure relate to a biomass gasifier that can produce syngas. Some of the various embodiments of the present disclosure include a first tube 72 having an air distribution manifold 80 that extend within the gasification chamber. The first tube 72 has an air passage that is fluidly connected to an air source 12 to deliver air to the combustion chamber through a plurality of air outlets 82 within the air distribution manifold 80 for distribution. In some embodiments, the first tube 72 is rotatably positioned within a second tube 70, where the second tube 70 is connected to a mixer below the air distribution manifold 80. In some embodiments, the first tube 72 is independently rotated from the second tube 70 to evenly distribute air within the combustion chamber and the second tube 70 with the mixer are rotated to agitate the biomass within the combustion chamber.

It is preferred in the example embodiments that operation of the gasifier unit 20 results in a high quality of syngas produced from the partial combustion of the biomass. It is also preferred in the example embodiments that the gasification temperatures within the combustion chamber are stabilized and consistent to avoid hot spots and cold spots within the reduction reaction chamber 42. It is further preferred in the example embodiments that the creation of clinkers is reduced or eliminated with biomass material having high silica content.

B. Gasifier Unit.

Figure 2:
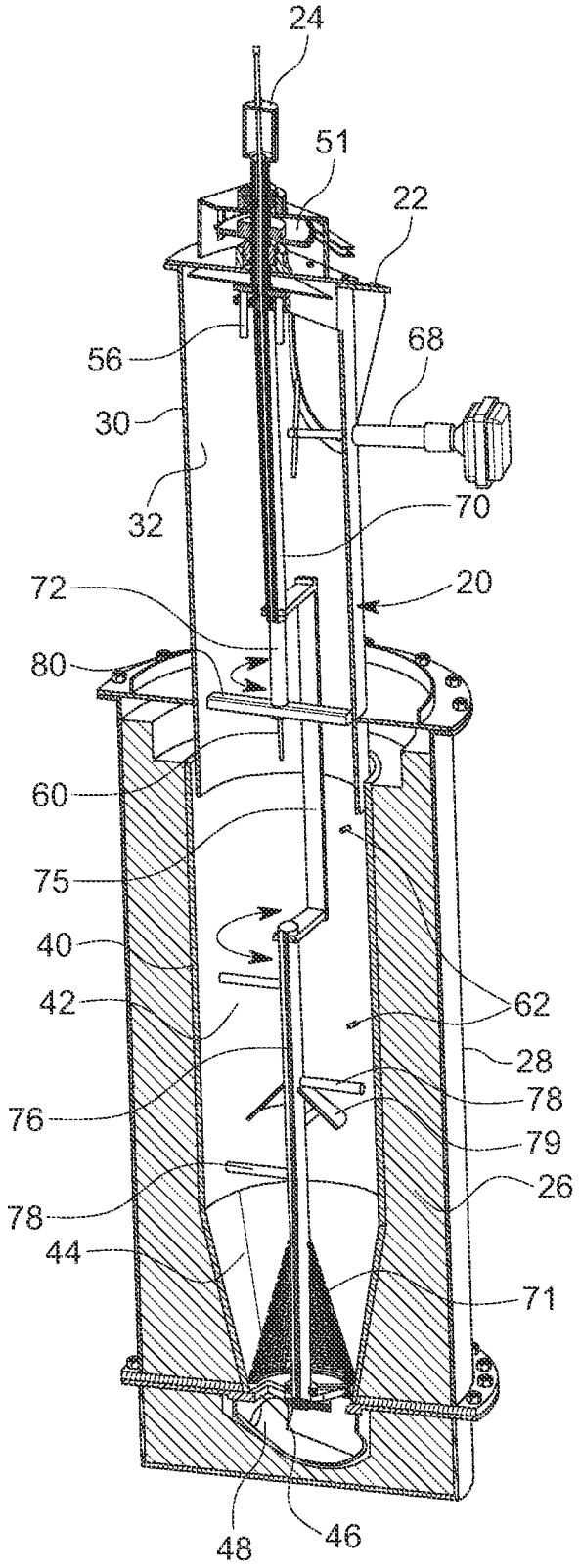
FIG. 2 is a cross sectional view taken along line 2-2 of FIG. 1.
Figure 3:
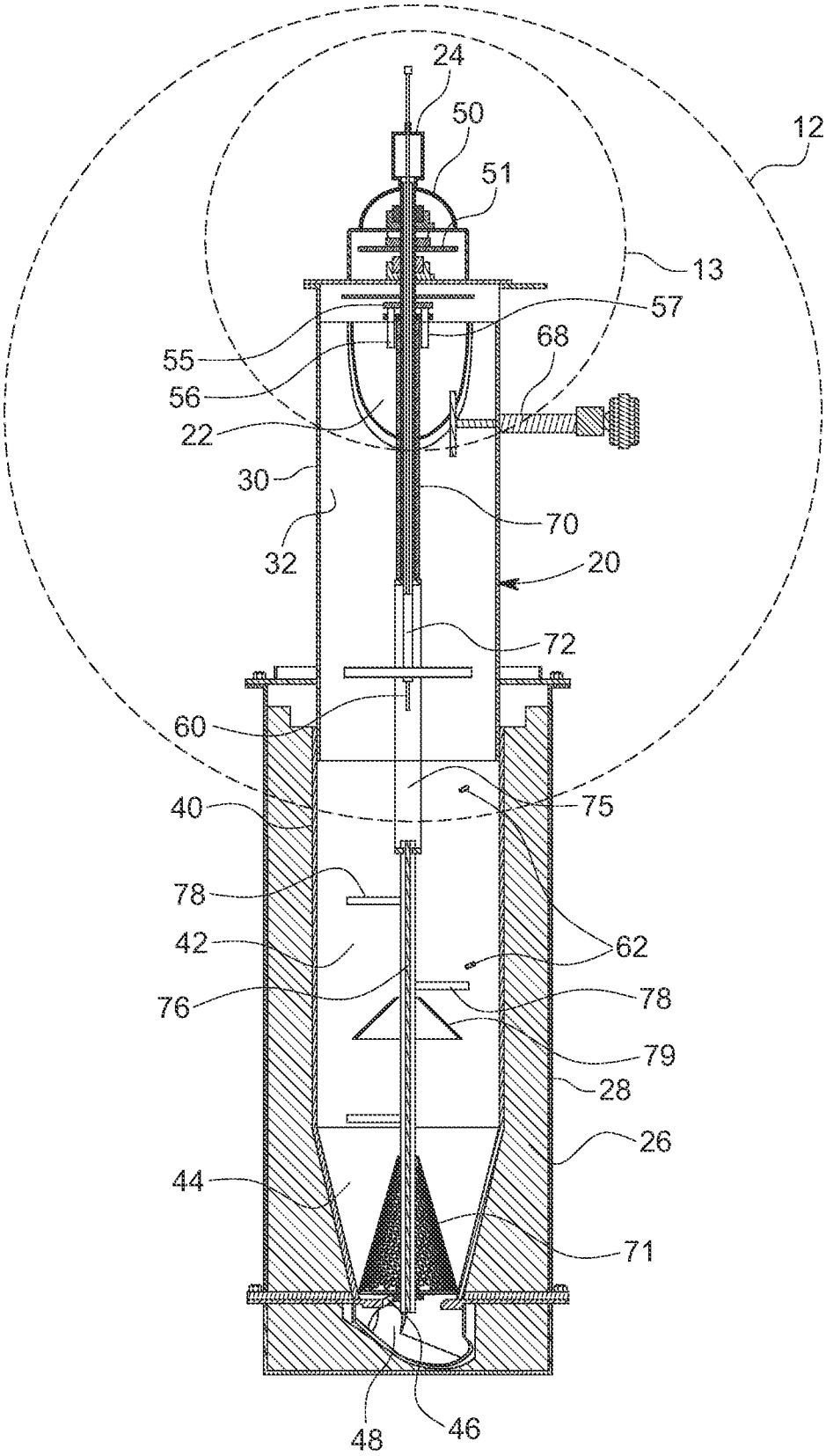
FIG. 3 is a front view of FIG. 2.

Example embodiments of the gasifier unit 20 are shown in FIGS. 1, 2 and 3 of the drawings. The gasifier unit 20 includes a combustion chamber where the biomass is partially combusted at high temperatures (e.g., 700 to 800 degrees Celsius) within a reduction reaction chamber 42 of the combustion chamber. The upper combustion chamber 32 within the combustion chamber that receives the new biomass partially combusts the biomass material at lower temperatures (e.g. 30 degree Celsius). The biomass material is inputted into the internal combustion chamber through a biomass inlet 22 which may be comprised of any device capable of inserting biomass into the combustion chamber to continue the desired operation of the gasifier unit 20. In one embodiment as shown in FIGS. 2 and 3, the upper combustion chamber 32 and the reduction reaction chamber 42 are continuous within the combustion chamber without a significant physical separator between the upper combustion chamber 32 and the reduction reaction chamber 42.

A biomass level sensor 68 detects when the biomass material fills a significant portion of the combustion chamber. One example embodiment of a biomass level sensor 68 uses a rotating motor 50 to rotate elongated members and a sensor to detect the rotation as shown in FIGS. 1, 2, 3 and 12 of the drawings. If the rotation of the biomass level sensor 68 stops, then the biomass level sensor 68 communicates to the control unit 10 that the combustion chamber is full of biomass and to terminate inputting additional biomass into the gasifier unit 20.

In one example embodiment shown in FIGS. 2 and 3 of the drawings, the gasifier unit 20 includes an upper portion 30 and a lower portion 40 that are slidably connected to one another to allow for expansion during the gasification of the biomass material. The upper portion 30 and the lower portion 40 are show in the example embodiments as having circular cross-sectional shapes, however, various other shapes may be used for the gasifier unit 20. It further can be appreciated that various sizes of the gasifier unit 20 are achievable by scaling the size of the system up or down based on the requirements for a project.

In one embodiment, an outer housing 28 surrounds the gasifier unit 20 to help seal the combustion chamber. One or more layers of insulation 26 may be positioned between the outer housing 28 and the walls of the combustion chamber as shown in FIGS. 2 and 3 of the drawings.

In one example embodiment, the upper combustion chamber 32 has a relatively constant width but vary in width. In another example embodiment, the lower part of the reduction reaction chamber 42 may include a tapered portion 44 to direct the char towards a central portion of the reduction reaction chamber 42. A lower opening 46 within the reduction reaction chamber 42 is fluidly connected to an exhaust port 48 which receives the syngas and the char produced by the partial combustion of the biomass material within the combustion chamber.

C. Air Source.

FIG. 1 illustrates an air source 12 used to provide air to the interior of the combustion chamber. The air source 12 may be comprised of various types of air sources such as, but not limited to, air compressors, fans and the like. The air source 12 may provide air by itself or a combination of air with an added gas (e.g. oxygen) to help increase the efficiency of the gasifier unit 20. In one example embodiment, the air provided by the air source 12 is pressurized.

D. First Tube and Air Distribution Manifold.

Figure 12:
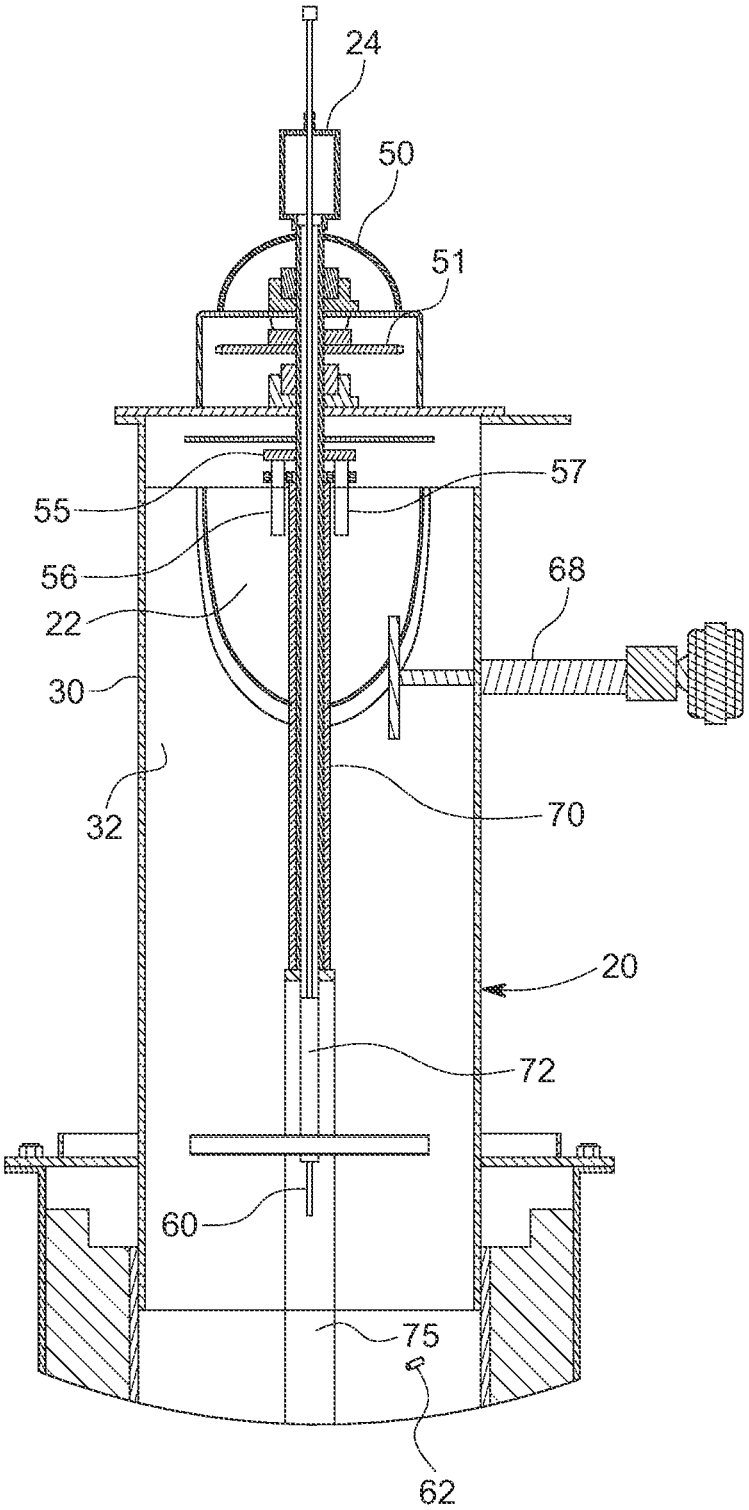
FIG. 12 is a magnified view from FIG. 3.

In one embodiment, a first tube 72 extends within the gasification chamber to distribute air from the air source 12 to the combustion chamber as illustrated in FIGS. 2, 3 and 12 of the drawings. The first tube 72 has at least one air passage that receives the air from the air source 12 and distributes the air to one or more desired locations within the combustion chamber.

Figure 13:
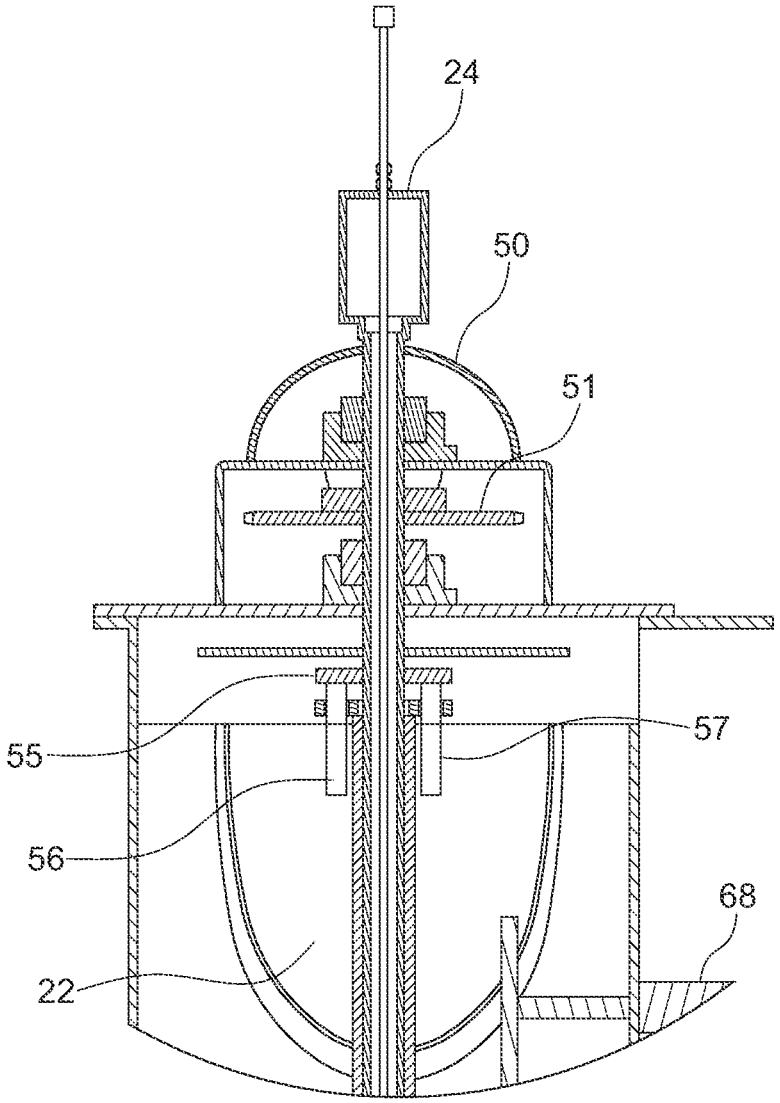
FIG. 13 is a magnified view from FIG. 3.

The first tube 72 is fluidly connected to the air source 12 by an air inlet 24 in one embodiment. In one example embodiment, the air inlet 24 is sealed with respect to the upper end of the first tube 72 while allowing rotation of the first tube 72 with respect to the air inlet 24 as shown in FIGS. 12 and 13 of the drawings. In one example embodiment shown in FIGS. 1 through 3, the air inlet 24 may be comprised of a chamber device that is fluidly connected to the air source 12 by an air line 14.

In one example embodiment, the first tube 72 extends downwardly from the upper end of the gasifier unit 20 to a central portion of the combustion chamber. In another example embodiment shown in FIGS. 2 and 3 of the drawings, the first tube 72 extends downwardly from the upper end of the gasifier unit 20 to a location generally near the intersection of the upper portion 30 and the lower portion 40 of the gasifier unit 20. In another example embodiment shown in FIGS. 2 and 3, the first tube 72 extends downwardly from the upper end of the gasifier unit 20 to a lower location within the upper combustion chamber 32 above the reduction reaction chamber 42. In another example embodiment shown in FIGS. 2 and 3, the first tube 72 extends downwardly from the upper end of the gasifier unit 20 to a location near the upper end of the upper combustion chamber 32. In another example embodiment, the first tube 72 is concentrically positioned within the combustion chamber.

Figure 4:
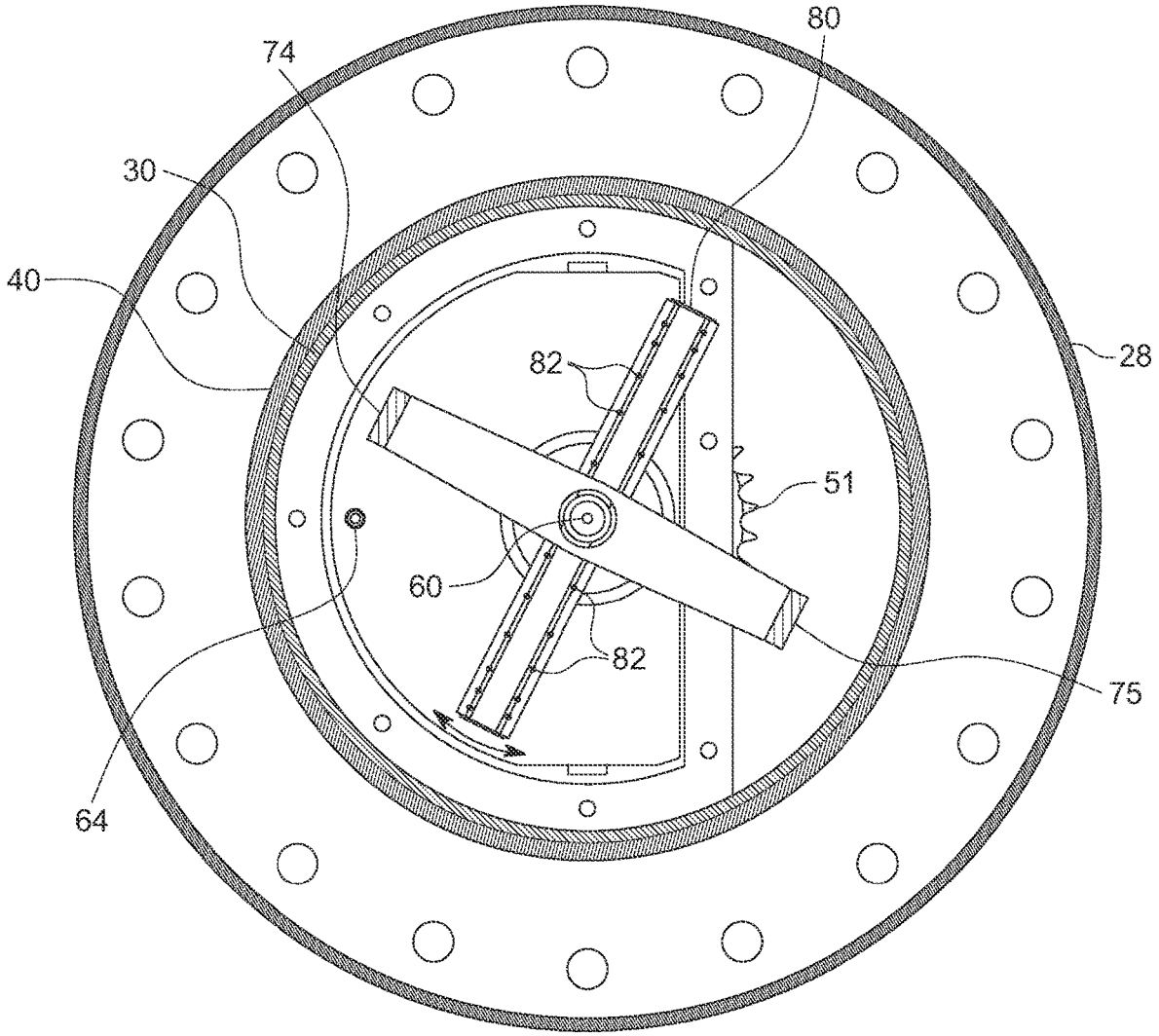
FIG. 4 is a cross sectional view taken along line 4-4 of FIG. 1.
Figure 5:
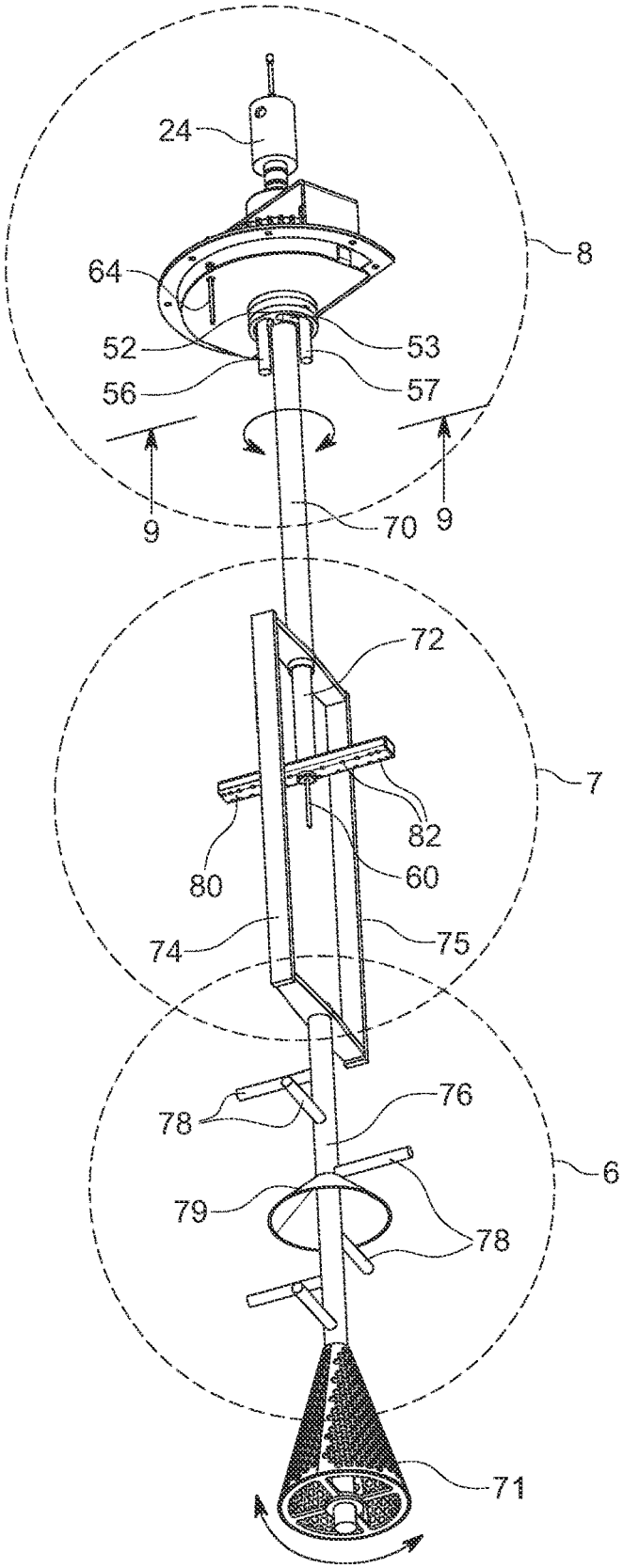
FIG. 5 is a lower perspective view of the air distribution system and mixing system in accordance with an example embodiment.
Figure 6:
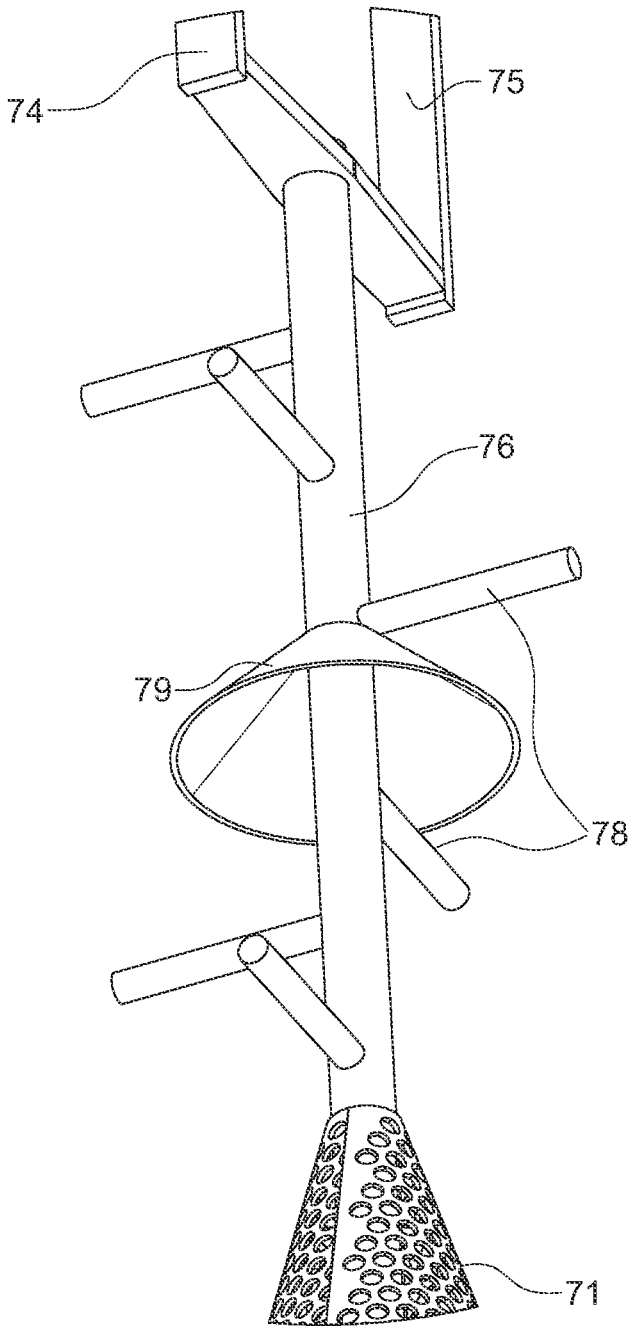
FIG. 6 is a magnified view from FIG. 5.
Figure 7:
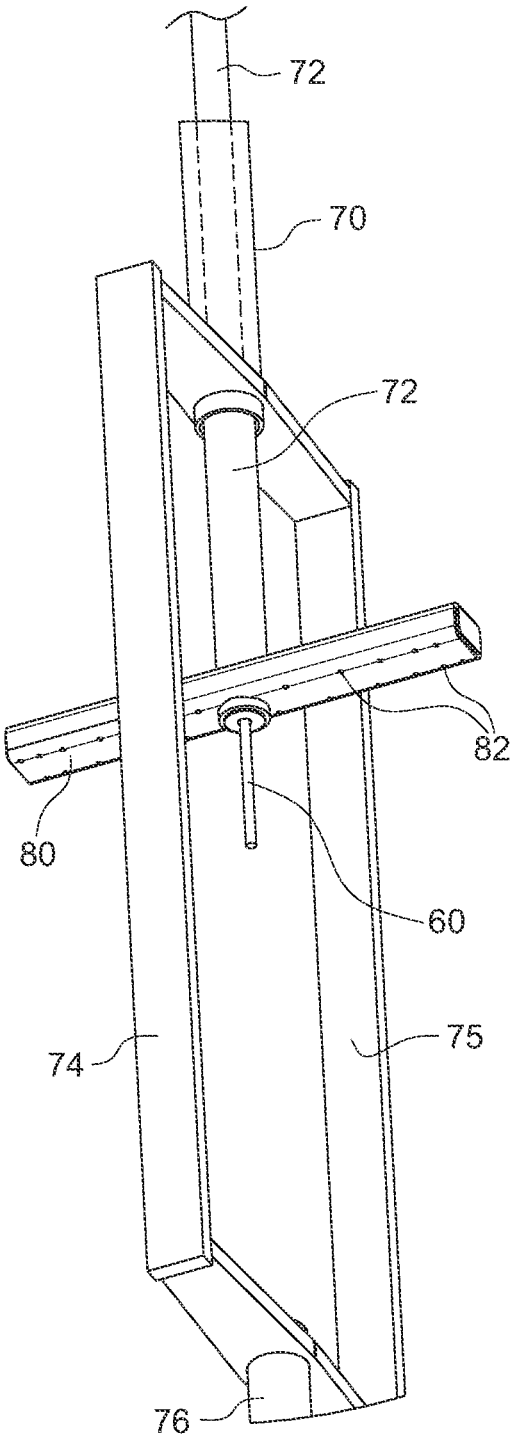
FIG. 7 is a magnified view from FIG. 5.

In one embodiment, the first tube 72 disperses the air from the air source 12 near a lower end of the first tube 72 into the combustion chamber into an upper portion 30 of the upper combustion chamber 32. In another example embodiment shown in FIGS. 2, 3, 4, 5, 7 and 12 of the drawings, the first tube 72 is connected to an air distribution manifold 80 that extends outwardly radially in opposing directions from the first tube 72 forming an inverted T-shaped structure. The air distribution manifold 80 has one or more passages that are fluidly connected between the air passage of the first tube 72 and the air outlets 82 to distribute the air relatively evenly from the air distribution manifold 80 into the high temperature are of the combustion chamber. In the example embodiment, the air distribution manifold 80 is fluidly connected to the air passage within the first tube 72 to receive the air from the air source 12. In the example embodiment, the air distribution manifold 80 includes a plurality of air outlets 82 (openings) that release the air from the air source 12 into the combustion chamber. In one example embodiment, the plurality of air outlets 82 extend into the bottom portion of the air distribution manifold 80 as illustrated for example in FIGS. 4 and 7 of the drawings. In one example embodiment, the air distribution manifold 80 is positioned near an upper end of the lower portion 40 of the gasification chamber to distribute the air into an upper part of the reduction reaction chamber 42. In another example embodiment shown in FIGS. 2 and 3, the air distribution manifold 80 is positioned within a lower part of the upper portion 30 of the gasifier unit 20.

In one example embodiment, the air distribution manifold 80 extends outwardly from the lower end portion of the first tube 72 in opposing directions from the first tube 72. In another example embodiment shown in FIG. 3, the air distribution manifold 80 is a relatively straight structure that extends outwardly from opposing sides of the first tube 72 a distance away from the inner surface of the combustion chamber.

E. Temperature Sensors.

In one example embodiment, a main temperature sensor 60 is positioned near the upper part of the upper combustion chamber 32 to measure the temperature within the upper combustion chamber 32. In one example embodiment shown in FIGS. 2, 3, 5, 7 and 12, the main temperature sensor 60 may extend downwardly from a lower end of the first tube 72 into a central portion of the gasification chamber. In one example embodiment shown in FIGS. 2, 3, 5, 7 and 12, the main temperature sensor 60 may extend through the air inlet 24 then through the first tube 72 and extending below the lower end of the first tube 72 near the upper part of the reduction reaction chamber 42. In another example embodiment, the main temperature sensor 60 may extend downwardly into a central portion of the reduction reaction chamber 42 to measure various temperatures at various vertical locations within the reduction reaction chamber 42. In one example embodiment, the main temperature sensor 60 detects the temperature within an upper part of the reduction reaction chamber 42 in a central position between the sidewalls of the reduction reaction chamber 42. The temperature sensors may be any type of sensor capable of measuring temperature data such as, but not limited to, a thermocouple.

Secondary temperature sensors may also be used in addition to the main temperature sensor 60. FIGS. 2 and 3 illustrate examples of a plurality of secondary temperature sensors 62 extending inwardly from the wall of the reduction reaction chamber 42 to measure the temperature within the reduction reaction chamber 42 near the wall of the reduction reaction chamber 42. In another embodiment, various other temperature sensors may extend from the wall of the upper combustion chamber 32.

In another embodiment, an upper temperature sensor 64 may extend downwardly into the upper part of the upper combustion chamber 32 to measure the temperature within the upper combustion chamber 32. In another embodiment, the main temperature sensor 60, the secondary temperature sensors 62 and the upper temperature sensor 64 are in communication with the control unit 10 to provide temperature data to the control unit 10 to help the control unit 10 determine how to change the operation of the motor 50 and the air source 12.

F. Motor.

Figure 14:
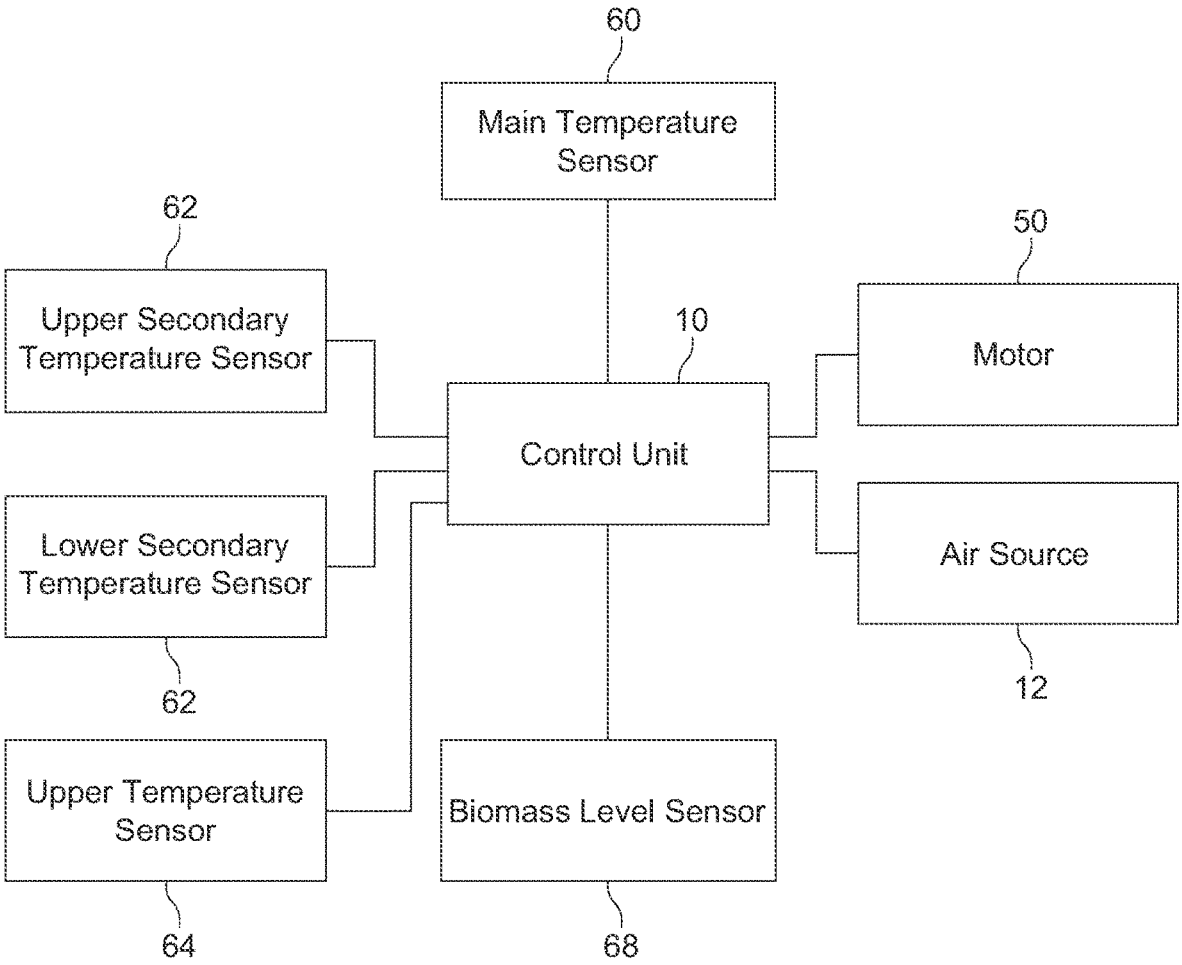
FIG. 14 is a block diagram illustrating the communications of the control unit with other electronic devices.

In one embodiment, a motor 50 is connected to the first tube 72 to rotate the first tube 72. In one example embodiment, the motor 50 is adapted to rotate the first tube 72 in a first direction and a second direction. In another embodiment shown in FIGS. 1, 2, 3, 12 and 13 of the drawings, a drive gear 51 is attached to the first tube 72 and the motor 50 is connected to the drive gear 51 to drive the rotation of the first tube 72. Various other connections may be used between the motor 50 and the first tube 72. In one embodiment, the motor 50 is in communication with and controlled by the control unit 10 as illustrated in FIG. 14 of the drawings.

The motor 50 may have a constant or adjustable rotational speed. The motor 50 may rotate in a single direction or bidirectional manner. In one embodiment, a gear box is positioned between the motor 50 and the drive gear 51. The motor 50 may be any type of motor 50 such as, but not limited to, an electric motor 50.

G. Second Tube.

In one example embodiment shown in FIGS. 2, 3 and 12 of the drawings, the second tube 70 partially surrounds the first tube 72 in a rotatable manner with the upper end and lower end of the first tube 72 extending outwardly from the second tube 70. The first tube 72 rotates within the second tube 70 so that the air distribution manifold 80 may be rotated with or without the mixer being rotated.

In one embodiment, the second tube 70 may be vertically supported by a bearing connected between the second tube 70 and the first tube 72. In another embodiment, the lower end of the first tube 72 may include a lip that extends outwardly to maintain the second tube 70 in a desired vertical location while allowing independent rotation of the first tube 72 with respect to the second tube 70.

In one example embodiment, the first tube 72 has an upper end that extends outwardly above the second tube 70. In another example embodiment, the first tube 72 has a lower end that extends downwardly below the second tube 70. In one embodiment, the air distribution manifold 80 is connected to the first tube 72 at or near the lower end of the first tube 72 as illustrated in FIGS. 2, 3, 5, 7 and 12 of the drawings.

H. Mixer.

In one embodiment, a mixer is attached to the second tube 70 and extends into the reduction reaction chamber 42 to agitate the biomass and char within the reduction reaction chamber 42 when an increased temperature is required. The mixer may be comprised of various types of structures capable of mixing the biomass and char.

In one example embodiment shown in FIGS. 2, 3, 5 and 6 of the drawings, the mixer may be a first outer member 74 having a first segment that extends outwardly from the second tube 70 past one of the ends of the air distribution manifold 80 and a second segment that extends downwardly below the air distribution manifold 80. In another example embodiment shown in FIGS. 5 and 7, the mixer may also include a second outer member 75 having a structure that mirrors the first outer member 74.

In one embodiment, a lower member 76 extends downwardly from the first outer member 74 and the second outer member 75 centrally within the reduction reaction chamber 42. One or more agitator members 78 extend radially outwardly from the lower member 76. In one embodiment, the lower member 76 is concentrically aligned with the first tube 72 and the second tube 70. In one example embodiment, the first outer member 74 and the second outer member 75 are positioned so as to not interfere with the rotation of the air distribution manifold 80 so that the air distribution manifold 80 can be rotated independently of the mixer.

In another embodiment, an air deflector 79 is attached to the lower member 76 to deflect heated air away from the center portion of the reduction reaction chamber 42 which tends to follow near the outer surface of the lower member 76. In one embodiment, the air deflector 79 is comprised of a cone as shown in FIGS. 2, 3, 5 and 6 of the drawings.

In another embodiment, a lower grate 71 is connected to the lower member 76 and positioned to substantially cover the lower opening 46 within the reduction reaction chamber 42. In one example embodiment, the lower grate 71 is comprised of a mesh material formed into an inverted conical structure with the broadest portion of the inverted conical structure near and substantially covering the lower opening 46 of the reduction reaction chamber 42 as shown in FIG. 3 of the drawings.

I. Connecting System.

In one example embodiment, the first tube 72 is rotated independently of the second tube 70 when in a first mode of operation. In a second mode of operation of the first tube 72, the first tube 72 rotates correspondingly with the second tube 70. A connecting system is positioned between the first tube 72 and the second tube 70 to allow for selective connecting of the first tube 72 with the second tube 70 based on the mode of operation. For example, the connecting system does not connect the first tube 72 to the second tube 70 when in the first mode of operation to allow for the first tube 72 to rotate freely without rotating the second tube 70. As another example, the connecting system connects the first tube 72 to the second tube 70 when in the second mode of operation so that the second tube 70 rotates correspondingly to the rotation of the first tube 72.

Figure 9:
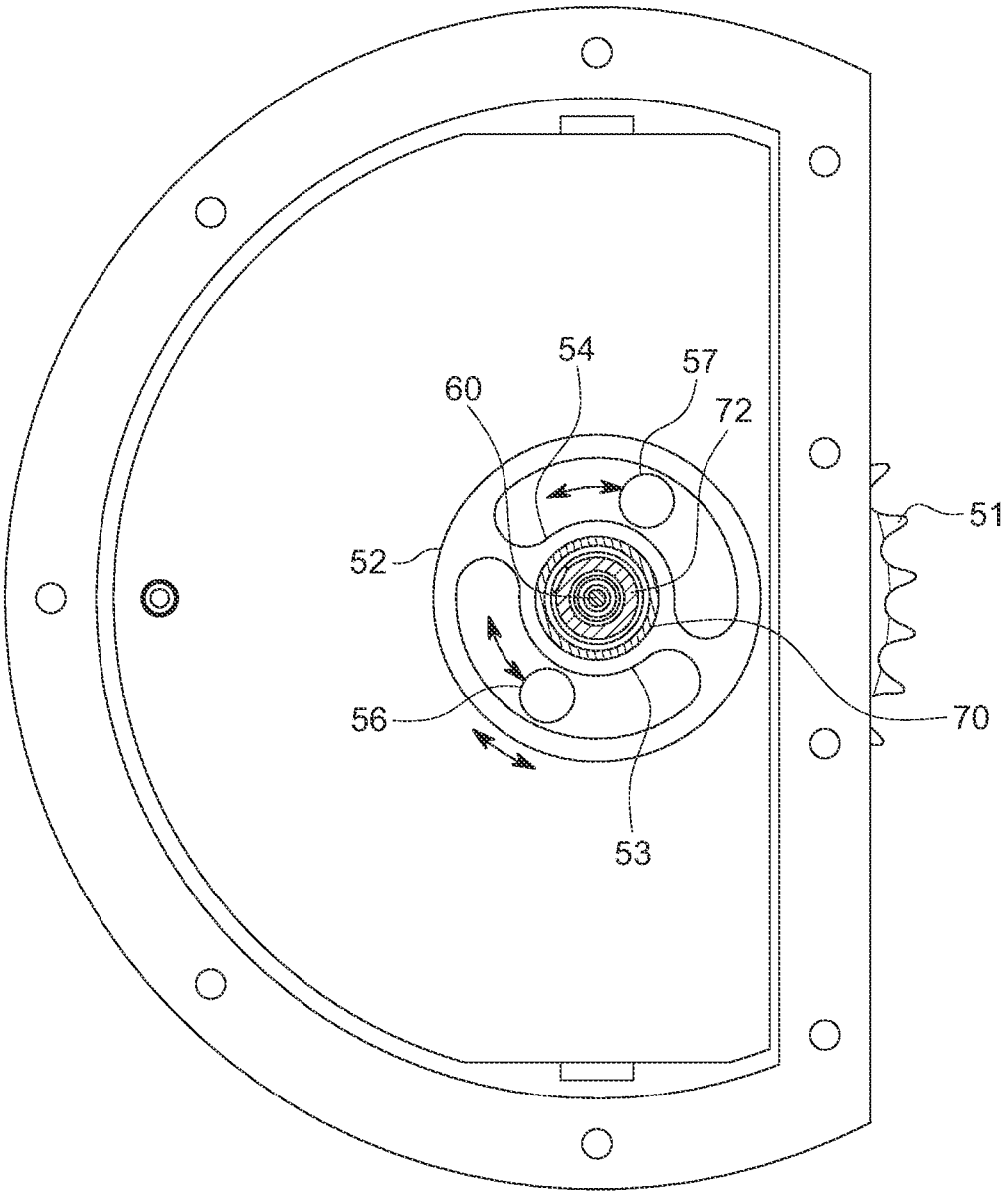
FIG. 9 is a cross sectional view taken along line 9-9 of FIG. 5.
Figure 10:
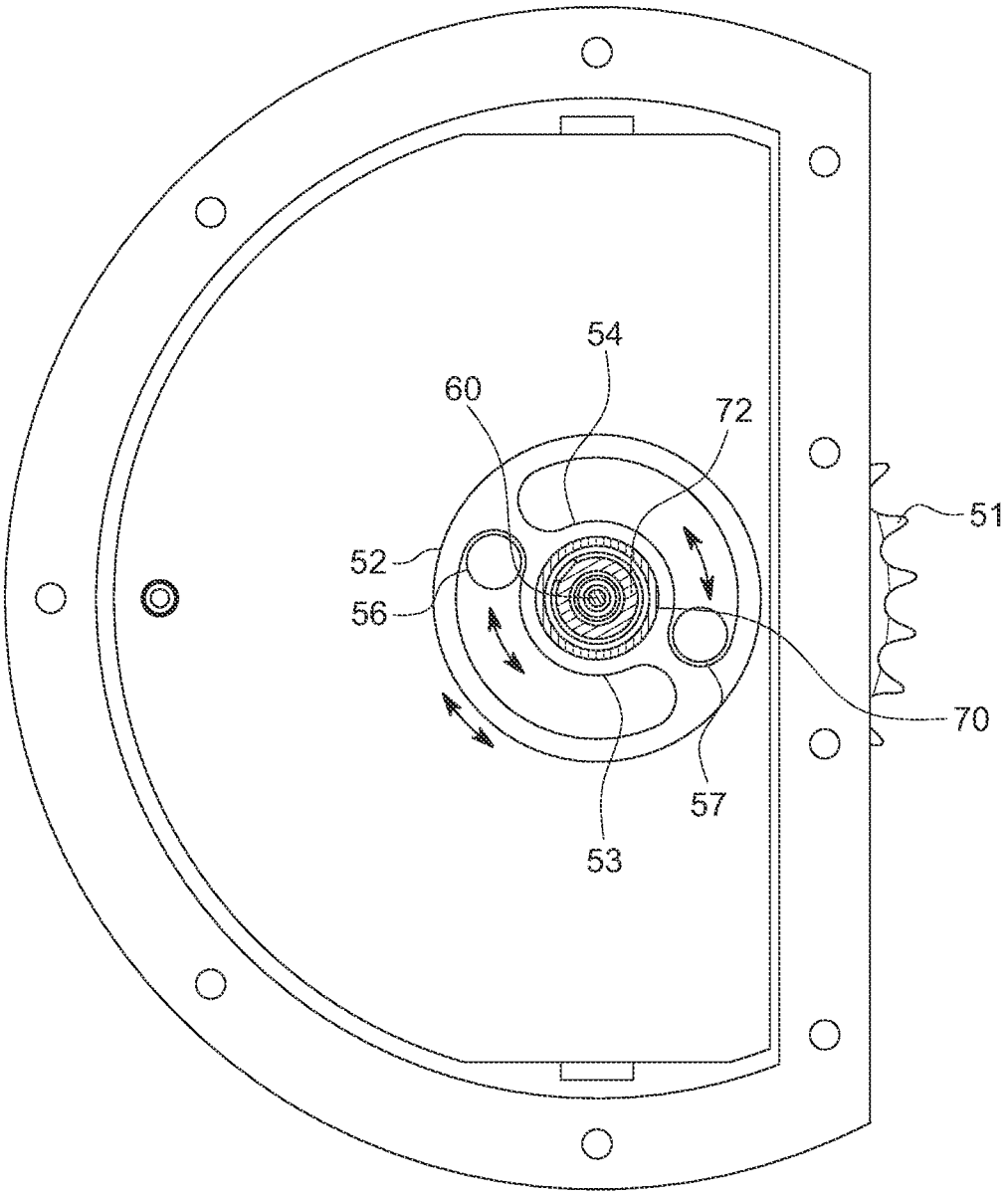
FIG. 10 is an illustration of FIG. 9 with the prongs rotated clockwise to engage and rotate the connecting member clockwise.
Figure 11:
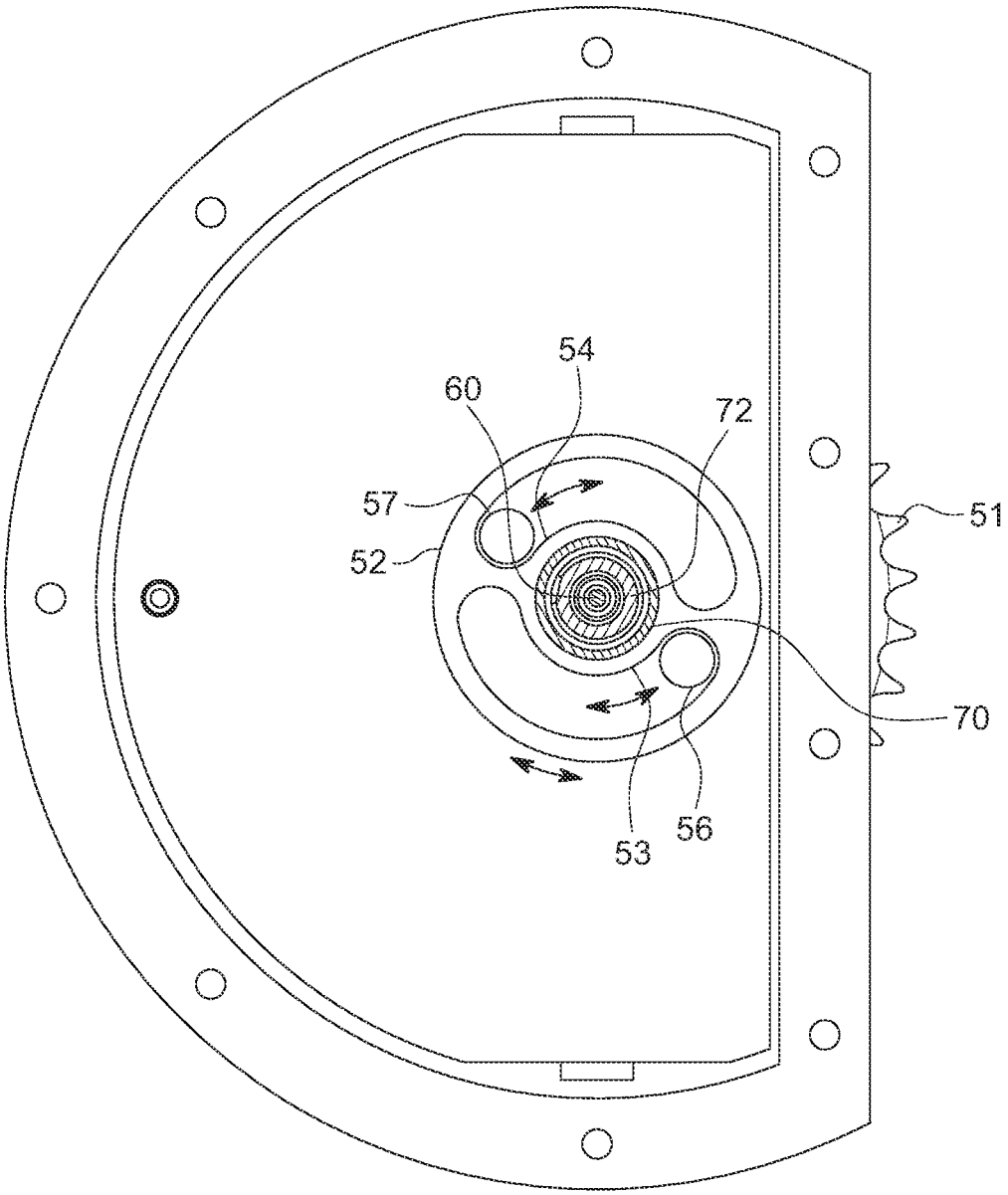
FIG. 11 is an illustration of FIG. 9 with the prongs rotated counterclockwise to engage and rotate the connecting member counterclockwise.

In one example embodiment, a connecting member 52 is connected to the second tube 70 and includes at least one slot. FIGS. 9 through 11 illustrate an example embodiment where the connecting member 52 includes a first slot 53 and a second slot 54 wherein the slots 53, 54 each have a curved shape.

In another example embodiment, a flange 55 is connected to the first tube 72 with at least one prong extending from the flange 55 and movably positioned within the at least one slot of the connecting member 52. FIGS. 9 through 11 illustrate an example embodiment where a first prong 56 extends from the flange 55 and is movably positioned within the first slot 53. FIGS. 9 through 11 further illustrate an example embodiment where a second prong 57 extends from the flange 55 and is movably positioned within the second slot 54.

In the first mode of operation, the first prong 56 and the second prong 57 rotate back and forth in a reciprocating manner within the corresponding slots 53, 54 without engaging the ends of the slots 53, 54 to allow for only rotation of the air distribution manifold 80 without rotation of the mixer (see FIG. 9 for example). In the second mode of operation, when the first prong 56 and second prong 57 engage an end of the first slot 53 and the second slot 54 respectively, the prongs 56, 57 then move the connecting member 52 along with the connected second tube 70 so that the mixer is correspondingly rotated with the air distribution manifold 80 to help increase the temperature within the reduction reaction chamber 42 (see FIGS. 10 and 11 for example).

J. Control Unit.

In one example embodiment illustrated in FIG. 14, the control unit 10 is in communication with the motor 50, the main temperature sensor 60, the secondary temperature sensors 62, the upper temperature sensor 64 and the air source 12. The control unit 10 may be any electronic device with memory and a processor.

In one embodiment, the control unit 10 is configured to control the motor 50 to rotate the first tube 72 in a first manner when a measured temperature measured by the main temperature sensor 60 is at or above a desired temperature. For example, the control unit 10 may have the motor 50 rotate the first tube 72 and the prongs 56, 57 in a reciprocating manner where the prongs 56, 57 do not engage the ends of the slots 53, 54 when moving clockwise (or counterclockwise) thereby allowing the first tube 72 along with the air distribution manifold 80 to freely rotate without the mixer rotating.

In one embodiment, the control unit 10 is configured to control the motor 50 to rotate the first tube 72 in a second manner when the measured temperature measured by the main temperature sensor 60 is below the desired temperature. For example, the control unit 10 may have the motor 50 rotate the first tube 72 and the prongs 56, 57 in a manner where the prongs 56, 57 engage the ends of the slots 53, 54 and continue their rotation thereby rotating the connecting member 52 along with the second tube 70 and the mixer in effect locking the rotation of the second tube 70 with respect to the first tube 72. Various other functions and operations may be used with respect to the various embodiments discussed herein.

K. Operation of Preferred Embodiment.

i. Preheating of Biomass Material.

In use, the air within the combustion chamber is preheated to a desired preheat temperature range (e.g., 600 degrees Celsius) using a process heater (e.g. electric) that is distributed into the combustion chamber.

After the air temperature within the combustion chamber is preheated to the desired preheat temperature, the biomass material is then input into the biomass gasifier through the biomass inlet 22 until the reduction reaction chamber 42 and the upper combustion chamber 32 are full of biomass material as detected by the biomass level sensor 68 and then the biomass inlet 22 stops entering new biomass material into the combustion chamber. The biomass material within the reduction reaction chamber 42 of the combustion chamber is preheated using the injected gas that is ignited to preheat the biomass material to a desired initial temperature range (e.g., approximately 250-500 degrees Celsius) to initiate the biomass gasification process.

After the biomass is added as described, the biomass begins to combust. In one example embodiment, the startup gas created by this combustion leaves through an exit tube having a valve. That gas then enters a mix tube which adds propane and ignites the mixed gas. That gas then enters the syngas combustion chamber (not shown) preheating the chamber to 500-600 C.

In one example embodiment, during the preheating of the biomass material, the air source 12 is providing air (and any other desired gases added to the air such as, but not limited to, oxygen) into the combustion chamber through the air outlets 82 within the air distribution manifold 80 where the air is distributed downwardly from above the upper combustion chamber 32. In another example embodiment, air is not dispersed by the air distribution manifold 80 from the air source 12 until the temperature of the biomass material within the reduction reaction chamber 42 reaches the desired initial temperature.

In one example embodiment, the first tube 72 and the air distribution manifold 80 are rotated when air from the air source 12 is distributed into the reduction reaction chamber 42. In another embodiment, the mixer may be rotated at the start of the preheating phase or later during the preheating phase to help agitate the biomass material and char within the reduction reaction chamber 42 to increase the combustion rate of the biomass material thereby increasing the temperature within the reduction reaction chamber 42.

ii. First Mode of Operation—Only First Tube Rotates.

In one example embodiment, the biomass material continues to combust during the preheating of the biomass material until the temperature detected by the main temperature sensor 60 reaches approximately 300 degrees Celsius, at that point the valve (referenced above) closes sealing the chamber and the propane is shut off. Ambient air is then added through the air outlets 82 of the air distribution manifold 80, causing the temperature at the main temperature sensor 60 to increase to approximately 700-800 degrees Celsius. When the main temperature sensor 60 detects a temperature of approximately 700-800 degrees Celsius which his transmitted to the control unit 10, the control unit 10 activates agitation of at least a portion of the material in the lower portion 50 be moving the second tube 70 to keep the temperature at the main temperature sensor 60 between approximately 700-800 degrees Celsius in accordance with an example embodiment of the present disclosure.

Figure 8:
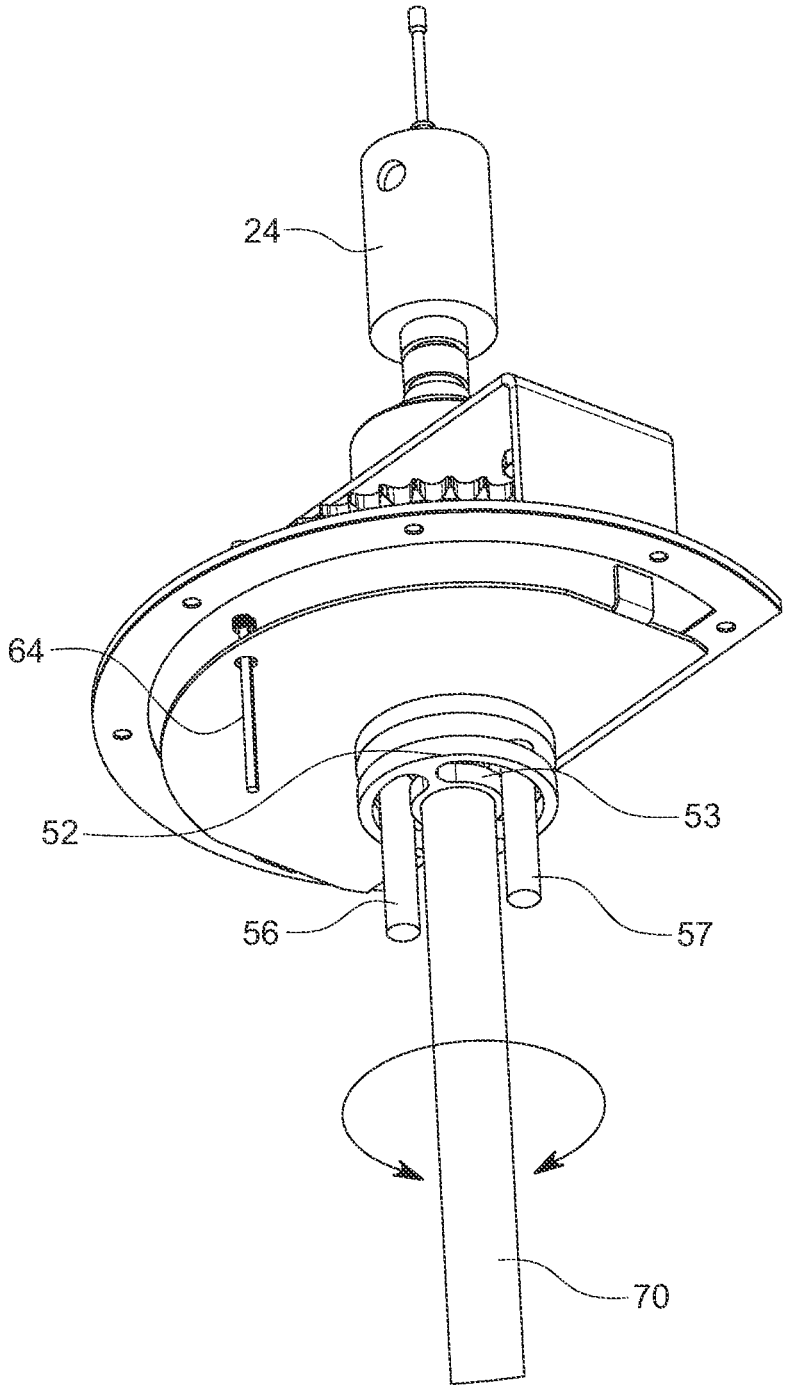
FIG. 8 is a magnified view from FIG. 5.

In another example embodiment, after preheating of the biomass material to the desired initial temperature has been accomplished, the first tube 72 along with the air distribution manifold 80 continue to rotate to evenly distribute the air into the reduction reaction chamber 42 to provide for a relatively consistent temperature through the biomass to avoid hot spots or cold spots. During the first mode of operation, only the first tube 72 along with the air distribution manifold 80 rotate without the second tube 70 (or the mixer) rotating. In one example embodiment, the motor 50 rotates the first tube 72 back and forth within a limited range of rotational movement (e.g. 0 to 160 degrees) to prevent the prongs 56, 57 from engaging the ends of the slots 53, 54 as shown in FIG. 8 of the drawings. This reciprocating action ensures even distribution of the air into the reduction reaction chamber 42 without moving the mixer. In one example embodiment, it takes approximately 23 seconds for the motor 50 to rotate the first tube 72 along with the air distribution manifold 80 approximately 130 degrees while in the first mode of operation.

In one example embodiment, the first mode of operation where only first tube 72 with the air distribution manifold 80 rotates continues until the temperature measured by the main temperature sensor 60 detects that the temperature within the reduction reaction chamber 42 is at approximately a desired operating temperature range. In one example embodiment, the desired operating temperature range in the reduction reaction chamber 42 as measured by the main temperature sensor 60 is approximately 700-1,100 degrees Celsius. In one example embodiment, when the desired operating temperature range is detected by the main temperature sensor 60, the control unit 10 changes the operation mode from the first mode of operation to the second mode of operation where both the first tube 72 and the second tube 70 with the mixer are rotated together.

iii. Second Mode of Operation—First and Second Tubes Rotate.

In one example embodiment, when the desired operating temperature range (for example, approximately 700-1,100 degrees Celsius) within the reduction reaction chamber 42 is detected by the main temperature sensor 60, the control unit 10 changes the operation mode from the first mode of operation to the second mode of operation where both the first tube 72 and the second tube 70 with the mixer are rotated together. In the second mode of operation illustrated in FIGS. 10 and 11, the motor 50 rotates the first tube 72 in a single direction instead of a reciprocating bidirectional manner so that the prongs 56, 57 engage the ends of the slots 53, 54 thereby coupling the rotational movement of the first tube 72 and the second tube 70 together so that the second tube 70 along with the mixer rotate correspondingly to the rotation of the first tube 72. The rotation of the mixer agitates and mixes the biomass material and char material within the reduction reaction chamber 42 as the mixer rotates within the reduction reaction chamber 42.

The partially combusted biomass material within the combustion chamber produces syngas that passes downwardly through the lower opening 46 with the reduction reaction chamber 42 through an exhaust port 48. The syngas that passes through the exhaust port 48 may be used for various applications (e.g. heating, electricity generation, operation of motors, etc.) or may be stored for later use. The syngas may also be further refined for various other applications.

During rotation of the mixer and the lower member 76, a slight space may form between the biomass material and char with respect to the outer surface of the lower member 76 thereby creating an efficient pathway for the air to pass along without evenly mixing throughout the biomass material. In one example embodiment, an air deflector 79 is attached to a central portion or lower part of the lower member 76 to deflect the air away from the outer surface of the lower member 76 back into the body of the biomass material and char within the reduction reaction chamber 42 to help provide even temperatures within the biomass material and char.

In one example embodiment, the lower grate 71 having a plurality of openings is attached to the lower part of the lower member 76 to meter the biomass material and char entering the exhaust port 48. In one embodiment, the openings within the lower grate 71 are set to a size and pattern that prevents undesirable material from falling into the exhaust port 48.

Unless otherwise defined, all technical and scientific terms used herein have the same meaning as commonly understood by one of ordinary skill in the art to which this invention belongs. Although methods and materials similar to or equivalent to those described herein can be used in the practice or testing of the various embodiments of the present disclosure, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The various embodiments of the present disclosure may be embodied in other specific forms without departing from the spirit or essential attributes thereof, and it is therefore desired that the various embodiments in the present disclosure be considered in all respects as illustrative and not restrictive. Any headings utilized within the description are for convenience only and have no legal or limiting effect.

What is claimed is:

1. A biomass gasifier, comprising:

a gasification chamber having an upper portion and a lower portion, wherein the upper portion is slidable with respect to the lower portion;

an air inlet adapted to be fluidly connected to an air source;

a first tube extending within the gasification chamber, wherein the first tube has an air passage, and wherein the air passage of the first tube is fluidly connected to the air inlet to receive air from the air source;

an air distribution manifold connected to the first tube, wherein the air distribution manifold is fluidly connected to the air passage, and wherein the air distribution manifold includes a plurality of air outlets to disperse air received from the air passage;

a motor connected to the first tube to rotate the first tube;

a second tube partially surrounding the first tube, wherein the first tube rotates within the second tube; and a mixer attached to the second tube.

2. The biomass gasifier of claim 1, wherein the first tube has an upper end and a lower end, wherein the upper end extends outwardly above the second tube, and wherein the lower end extends downwardly below the second tube.

3. The biomass gasifier of claim 2, wherein the air distribution manifold is connected to the first tube at or near the lower end of the first tube.

4. The biomass gasifier of claim 1, wherein the air distribution manifold forms an inverted T-shaped structure with the first tube.

5. The biomass gasifier of claim 1, wherein the air distribution manifold is positioned near an upper end of the lower portion of the gasification chamber.

6. The biomass gasifier of claim 1, further comprising:

a connecting member connected to the second tube, wherein the connecting member includes at least one slot;

a flange connected to the first tube; and at least one prong extending from the flange, wherein the at least one prong is movably positioned within the at least one slot, and wherein when the at least one prong engages an end of the at least one slot the at least one prong rotates the connecting member, the second tube and the mixer.

7. The biomass gasifier of claim 1, wherein the mixer is comprised of:

an outer member has a first segment and a second segment, wherein the first segment extends outwardly from the second tube past the air distribution manifold, and wherein the second segment extends downwardly below the air distribution manifold;

a lower member extending from the second segment; and a plurality of agitator members extending from the lower member.

8. The biomass gasifier of claim 7, including an air deflector attached to the lower member.

9. The biomass gasifier of claim 1, wherein the plurality of air outlets are within a bottom portion of the air distribution manifold.

10. A biomass gasifier, comprising:

a gasification chamber having an upper portion having an upper combustion chamber and a lower portion having a reduction reaction chamber;

an air inlet fluidly connected to an air source;

a first tube extending within the gasification chamber, wherein the first tube has an air passage, and wherein the air passage of the first tube is fluidly connected to the air inlet to receive air from the air source;

an air distribution manifold connected to the first tube, wherein the air distribution manifold is fluidly connected to the air passage, and wherein the air distribution manifold includes a plurality of air outlets to disperse air received from the air passage;

a main temperature sensor extending downwardly from a lower end of the first tube into a central portion of the gasification chamber;

a motor connected to the first tube to rotate the first tube;

a second tube partially surrounding the first tube, wherein the first tube rotates within the second tube;

a mixer attached to the second tube; and a control unit in communication with the motor and the main temperature sensor, wherein the control unit is programmed to control the motor to rotate the first tube in a first manner when a measured temperature measured by the main temperature sensor is at or above a desired temperature, and wherein the control unit is programmed to control the motor to rotate the first tube in a second manner when the measured temperature measured by the main temperature sensor is below the desired temperature.

11. The biomass gasifier of claim 10, wherein the upper portion is slidable with respect to the lower portion.

12. The biomass gasifier of claim 10, wherein the first tube has an upper end and a lower end, wherein the upper end extends outwardly above the second tube, and wherein the lower end extends downwardly below the second tube.

13. The biomass gasifier of claim 12, wherein the air distribution manifold is connected to the first tube at or near the lower end of the first tube.

14. The biomass gasifier of claim 10, wherein the air distribution manifold forms an inverted T-shaped structure with the first tube.

15. The biomass gasifier of claim 10, wherein the air distribution manifold is positioned near an upper end of the lower portion of the gasification chamber.

16. The biomass gasifier of claim 10, further comprising:

a connecting member connected to the second tube, wherein the connecting member includes at least one slot;

a flange connected to the first tube; and at least one prong extending from the flange, wherein the at least one prong is movably positioned within the at least one slot, and wherein when the at least one prong engages an end of the at least one slot the at least one prong rotates the connecting member, the second tube and the mixer.

17. The biomass gasifier of claim 10, wherein the mixer is comprised of:

an outer member has a first segment and a second segment, wherein the first segment extends outwardly from the second tube past the air distribution manifold, and wherein the second segment extends downwardly below the air distribution manifold;

a lower member extending from the second segment; and a plurality of agitator members extending from the lower member.

18. The biomass gasifier of claim 17, including an air deflector attached to the lower member.

19. A biomass gasifier, comprising:

a gasification chamber having an upper portion having an upper combustion chamber and a lower portion having a reduction reaction chamber, wherein the upper portion is slidable with respect to the lower portion;

an air inlet fluidly connected to an air source;

a first tube extending within the gasification chamber, wherein the first tube has an air passage, and wherein the air passage of the first tube is fluidly connected to the air inlet to receive air from the air source;

an air distribution manifold connected to the first tube, wherein the air distribution manifold is fluidly connected to the air passage, wherein the air distribution manifold includes a plurality of air outlets to disperse air received from the air passage, wherein the air distribution manifold is positioned near an upper end of the lower portion of the gasification chamber, and wherein the plurality of air outlets are within a bottom portion of the air distribution manifold;

a main temperature sensor extending downwardly from a lower end of the first tube into a central portion of the gasification chamber;

a motor connected to the first tube to rotate the first tube;

a second tube partially surrounding the first tube, wherein the first tube rotates within the second tube;

wherein the first tube has an upper end and a lower end, wherein the upper end extends outwardly above the second tube, wherein the lower end extends downwardly below the second tube, wherein the air distribution manifold is connected to the first tube at or near the lower end of the first tube;

a mixer attached to the second tube;

a connecting member connected to the second tube, wherein the connecting member includes at least one slot;

a flange connected to the first tube;

at least one prong extending from the flange, wherein the at least one prong is movably positioned within the at least one slot, and wherein when the at least one prong engages an end of the at least one slot the at least one prong rotates the connecting member, the second tube and the mixer; and a control unit in communication with the motor and the main temperature sensor, wherein the control unit is configured to control the motor to rotate the first tube in a first manner when a measured temperature measured by the main temperature sensor is at or above a desired temperature, and wherein the control unit is configured to control the motor to rotate the first tube in a second manner when the measured temperature measured by the main temperature sensor is below the desired temperature.

* * * * *